United States Patent [19]

Takamatsu

[11] 3,952,380

[45] Apr. 27, 1976

[54] CONCEALED SLIDE FASTENER HAVING WARP-KNITTED STRINGER TAPES

[75] Inventor: Ikuo Takamatsu, Uozu, Japan

[73] Assignee: Yoshida Kogyo Kabushiki Kaisha, Japan

[22] Filed: Oct. 29, 1974

[21] Appl. No.: 518,632

[30] Foreign Application Priority Data

Nov. 9, 1973 Japan ..... 48-130074[U]

[52] U.S. Cl. ..... 24/205.13 C; 24/205.16 C

[51] Int. Cl.[2] ..... A44B 19/12; A44B 19/40

[58] Field of Search ..... 24/205.1 R, 205.1 C, 24/205.13 C, 205.16 R, 205.16 C

[56] References Cited

UNITED STATES PATENTS 3,820,202 6/1974 Takamatsu ..... 24/205.1 C 3,849,842 11/1974 Yoshida ..... 24/205.1 C

FOREIGN PATENTS OR APPLICATIONS 1,531,836 7/1967 France ..... 24/205.1 C

*Primary Examiner*—Bernard A. Gelak

*Attorney, Agent, or Firm*—Bucknam and Archer

[57] ABSTRACT

A slide fastener of the concealed or masked type having a pair of opposed stringer tapes carrying along respective longitudinal edges a row of interlocking fastener elements. The stringer tape consists of a web portion and a marginal edge portion interconnected by a flexing portion which defines an axis of fold along which the tape is folded on itself. The marginal edge portion has alternate wales and grooves, said wales projecting in a direction opposite to those wales formed on the web portion.

2 Claims, 3 Drawing Figures

CONCEALED SLIDE FASTENER HAVING WARP-KNITTED STRINGER TAPES

BACKGROUND OF THE INVENTION

This invention relates to slide fasteners, more particularly to a slider-operated fastener of the concealed or masked type which in its closed disposition substantially simulates a garment seam.

Slide fasteners having two rows of interlocking fastener elements formed from a continuous filament or wire and secured to respective folded edges of opposed stringer tapes are well known, and such fasteners when closed by the slider mask the elements from external view, only leaving a linear seam in the junction of the opposed tapes.

The so-called "Concealed" slide fasteners of known type are designed to maintain the effect of concealing or masking the fastener elements by folding the respective element-carrying edges of stringer tapes on themselves about the sewn seam which secures the respective row of fastener elements to the tape and which extends longitudinally of the tape and outermost of the elements or close to the coupling heads thereof. Such known concealed type slide fasteners include stringer tapes of a warp-knitted structure having on one surface alternate longitudinal wales and inter-wale grooves, with fastener elements mounted on the other relatively flat surface along the respective longitudinal edges of the tapes which are folded. When attaching such a fastener to a garment or the like, it is necessary to unfold and erect the respective folded edges with the coupling heads of the fastener elements directed towards the plane of the garment and thereafter to sew the respective stringer tapes precisely along the longitudinal inter-wale grooves closest to the coupling heads of the elements. However, when the respective element-carrying edges of the tapes are thus erected substantially in an L-shaped fashion, the wales located on opposite sides of the inter-wale groove through which the sewing threads are to extend are urged toward each other, causing that particular inter-wale groove to be narrowed or otherwise crushed in a manner illustrated in FIG. 3 of the accompanying drawings, with the results that the sewing needle is liable to damage in contact with adjacent wales or to be mis-guided into other adjacent grooves away from the fastener elements. This has often led to mal-functioning of the concealed fastener.

SUMMARY OF THE INVENTION

With the above-noted deficiencies of the prior-art slide fasteners in view, it is an object of the present invention to provide an improvement in a concealed slide fastener comprising warp-knitted stringer tapes whereby the folded edge of the respective tape has a selected inter-wale groove close to the coupling heads of fastener elements so disposed, when the said edge is unfolded into a sewing position, as to retain sufficient width to allow the sewing needle to pass therethrough, thus obtaining a proper line of stitching that secures the fastener to a garment or the like.

To achieve this object and other related objects hereinafter set forth, the present invention provides a concealed slide fastener having a pair of opposed stringer tapes carrying respective rows of fastener elements, each of which stringer tapes comprising a web portion and a marginal edge portion. These portions are interconnected integrally by a flexing portion which defines an axis of fold for folding the respective stringer tape thereabout and which is deformable, in folded condition of the tape, with its opposed side wales spread outwardly away.

The features which are believed to be novel and characteristic of the invention are set forth with particularity in the appended claims, and will appear clear from the following description taken in conjunction with the accompanying drawings which illustrate by way of example a preferred embodiment and in which like reference characters denote like or corresponding parts throughout the views.

DETAILED DESCRIPTION OF THE PREFERRED EMBODIMENTS

Figure 1:
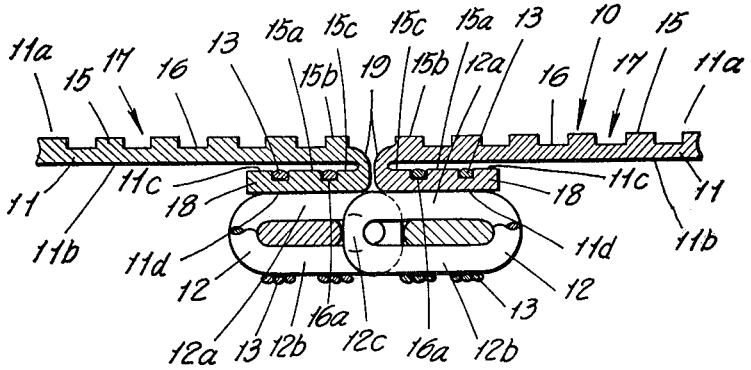
FIG. 1 is a transverse sectional view of a concealed slide fastener provided in accordance of the invention, with stringer tapes shown coupled together.
Figure 2:
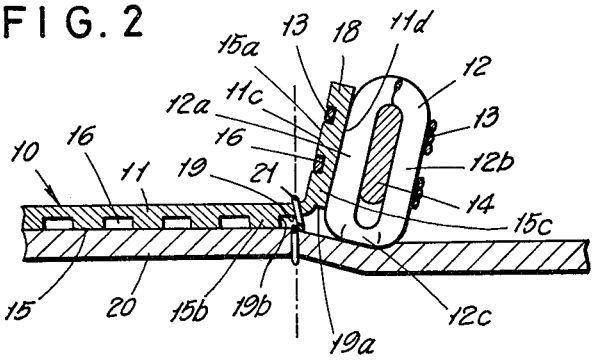
FIG. 2 is a transverse sectional view of one of a pair of stringer tapes of the invention, illustrating the element-carrying edge as in erected position for sewing the fastener to a garment fabric.
Figure 3:
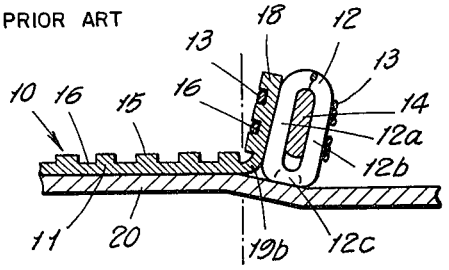
FIG. 3 PRIOR ART
FIG. 3 is a view similar to FIG. 2 but showing a prior-art construction for purposes of contrast to the invention.

Referring now to the drawings and particularly to FIG. 1, there is shown a concealed type slide fastener 10 which essentially comprises a pair of stringer tapes 11 and rows of fastener elements 12 mounted respectively thereon. More specifically, the row of elements 12 in the form of a spring coil are secured by means of sewing threads 13 to the respective tapes 11 and through the medium of a reinforcing cord 14 inserted longitudinally through the space between opposed legs 12*a*, 12*b* of the elements 12 in the usual manner. The stringer tape 11 is provided with a web portion 17 having on one surface 11*a* a multiplicity of alternate wales 15 and interwale grooves 16, while the other surface 11*d* of said portion is rendered flat. A tape of this structure is preferably formed by warp knitting for example with use of longitudinally extending chain stitches which form the wales 15, tricot stitches and transversely extending lapping threads laid in coursewise to interconnect the chain stitches, with the grooves 16 formed longitudinally between adjacent wales 15.

In accordance with the features of the invention, the stringer tape 11 is provided with a longitudinal marginal edge portion 18 contiguous to the web portion 17 for mounting thereon a row of fastener elements 12, which edge portion includes a plurality of alternate wales 15*a* and grooves 16*a* that are formed respectively on and in one surface 11*c* which in unfolded condition of the tape lies opposite to the surface 11*a* of the web portion 17, with the other or reverse surface 11*d* of said edge portion rendered substantially flat to be adapted for stably positioning the fastener elements 12.

The width of the marginal edge portion 18 may of course vary with the size of given fastener elements 12. In the illustrated embodiment, the edge portion 18 contains three wales 15*a* projecting in a direction opposite to the wales 15 of the web portion 17 and defining therebetween two inter-wale grooves 16*a* in which the sewing threads 13 are accommodated that secure the fastener elements 12 to the tape 11. It will be seen that the marginal edge portion 18 is connected to the web portion 17 by a recessed flexing portion 19 which is, in unfolded condition of the tape, defined integrally between the innermost wale 15*b* of the web portion 17 and the innermost wale 15*c* of the edge portion 18 adjacent the coupling heads 12*c* of the elements 12 and which forms a longitudinal axis of fold along which the tape 10 is folded on itself in the known manner as depicted in FIG. 1.

With this construction, when attaching the fastener 10 to for example a garment fabric 20, the marginal edge portion 18 of each stringer tape 11 is unfolded and flexed together with the fastener elements 12 along the flexing portion 19 outwardly into the erected position in which the coupling heads 12*c* are oriented to face the plane of the garment fabric 20.

When thus flexing the edge portion 18, the flexing portion 19 is deformed with its opposed side walls 19*a*, 19*b* spread outwardly away and in so doing provides unobstracted room for the passage of a sewing needle (not shown) so that the stitching 21 can be extended desirably through and along the recessed flexing portion 19 that lies close to the coupling heads 12*c* of the elements 12 thereby enabling the fastener 10 to be sewn properly onto the garment fabric 20 and thus maintaining the proper function of a concealed slide fastener.

What is claimed is:

1. A concealed slide fastener comprising a pair of opposed stringer tapes carrying respective rows of fastener elements, each of said stringer tapes having a longitudinal extending marginal edge portion to which a corresponding row of fastener elements is secured, a web portion, and a longitudinal extending flexing portion connecting said marginal edge and web portions and defining a longitudinal axis of fold to accommodate folding of the tape along said axis into a configuration in which part of the web portion overlaps the marginal edge portion, said web portion having a plurality of longitudinally extending alternate wales and grooves all on one side of the tape, and said edge portion having a generally flat surface on said one side of the tape, said flat surface being in contact with said row of fastener elements, said edge portion having a plurality of longitudinally extending alternate wales and grooves all on the opposite side of the tape, said flexing portion having a surface recessed in relation to the flat surface of the edge portion to accommodate folding the tape into said configuration with the edge portion and said part of the web portion facing each other on said opposite side of the tape and without interfering abutment between wales of said portions.

2. A concealed slide fastener according to claim 1 wherein said flexing portion is integrally connected to said web and marginal edge portions and extends transversely between the innermost wale of the web portion and the innermost wale of the marginal edge portion.

* * * * *